US011344104B2

(12) United States Patent
Miller

(10) Patent No.: US 11,344,104 B2
(45) Date of Patent: May 31, 2022

(54) RAPIDLY DEPLOYABLE PROTECTIVE BACKPACK

(71) Applicant: Brian M. Miller, Long Beach, CA (US)

(72) Inventor: Brian M. Miller, Long Beach, CA (US)

( * ) Notice: Subject to any disclaimer, the term of this patent is extended or adjusted under 35 U.S.C. 154(b) by 0 days.

(21) Appl. No.: 16/476,229

(22) PCT Filed: Jan. 18, 2019

(86) PCT No.: PCT/US2019/014328

§ 371 (c)(1),
(2) Date: Jul. 5, 2019

(87) PCT Pub. No.: WO2019/144028

PCT Pub. Date: Jul. 25, 2019

(65) Prior Publication Data

US 2021/0330060 A1 Oct. 28, 2021

Related U.S. Application Data

(60) Provisional application No. 62/619,604, filed on Jan. 19, 2018.

(51) Int. Cl.
*F41H 1/02* (2006.01)
*A45F 3/04* (2006.01)
(Continued)

(52) U.S. Cl.
CPC ..... *A45F 3/04* (2013.01); *F41H 1/02* (2013.01); *A45F 2003/003* (2013.01); *A45F 2003/045* (2013.01); *F41C 33/02* (2013.01)

(58) Field of Classification Search
CPC ..... F41H 1/02; A45F 3/04
(Continued)

(56) References Cited

U.S. PATENT DOCUMENTS 5,431,318 A * 7/1995 Garcia ..... F41C 33/00 2/2.5
5,657,917 A 8/1997 Johnson et al.
(Continued)

OTHER PUBLICATIONS

USPTO, International Search Report and Written Opinion, dated Apr. 4, 2019, from corresponding International Patent Application Serial No. PCT/US19/14328.

*Primary Examiner* — Nathan J Newhouse
*Assistant Examiner* — Lester L Vanterpool
(74) *Attorney, Agent, or Firm* — Charmasson, Buchaca & Leach, LLP

(57) ABSTRACT

A backpack (11) provides a protective utility vestment including a panel of armor material fully stored beneath the openable cover (22) an anterior chamber within the backpack, obscuring its existence. A pair of hand-graspable pull-tabs (31) connected to opposite lateral sides of the vestment allow rapid deployment of the vestment over the user's head and into position on the user's chest. The pull-tabs can be obscured on the shoulder supports (14,15) of the backpack until used. Decoy bands (43) on the shoulder supports can further enhance the obscuring effect. The pull-tabs can secure to the hip support pads (16,17) to further secure the vestment on the user's chest. A bottom deployed utility caddy can be stowed within a hidden medial compartment.

14 Claims, 10 Drawing Sheets

(51) Int. Cl.
*A45F 3/00* (2006.01)
*F41C 33/02* (2006.01)

(58) Field of Classification Search
USPC ..... 224/576
See application file for complete search history.

(56) References Cited

U.S. PATENT DOCUMENTS

| | | | | |
|---|---|---|---|---|
| 5,829,653 | A * | 11/1998 | Kaiser | F41C 33/046 224/577 |
| 6,419,132 | B1 * | 7/2002 | Reed | A45C 15/00 2/2.5 |
| 6,685,071 | B2 * | 2/2004 | Prather | F41H 5/08 2/2.5 |
| 10,130,160 | B1 | 11/2018 | Cheng et al. | |
| 2007/0295772 | A1 * | 12/2007 | Woodmansee | F41H 1/02 224/576 |
| 2010/0230458 | A1 * | 9/2010 | Kramer | A45F 3/04 224/581 |
| 2012/0018478 | A1 | 1/2012 | Hanna et al. | |
| 2017/0332768 | A1 | 11/2017 | Fraile Nuez | |
| 2017/0356724 | A1 * | 12/2017 | Richardson | F41H 5/0428 |
| 2019/0174903 | A1 * | 6/2019 | Holder | A45F 3/06 |

* cited by examiner

RAPIDLY DEPLOYABLE PROTECTIVE BACKPACK

PRIOR APPLICATION

This application claims the benefit of U.S. Provisional Patent Application Ser. No. 62/619,604, filed 2018 Jan. 19.

FIELD OF THE INVENTION

This invention relates to configurable body-worn items and more particularly to multifunctional backpacks.

BACKGROUND

Security personnel in public settings are often instructed to maintain a relatively low profile so that the public does not feel intimidated in public gatherings. However, it is important that security personnel in that setting carry with them all the equipment necessary to perform there duties. This means security personnel need ready access to weapons and protective gear while maintaining a low profile.

U.S. Pat. No. 6,419,132 to Reed et al., incorporated herein by reference, describes using a cartridge-like device attachable to the anterior face of a backpack. The cartridge carries an armored chest protector which can be deployed over the user's head and shoulders. The purpose of this device is readily apparent to bystanders because of the visibility of various features identifiably associated with the device including portions of the cartridge and the upwardly protruding handles.

Another drawback of the Reed et al device is the apparent deficiency of mechanisms for readily and rapidly affixing the protector device to the chest once the protector device is deployed.

It is well known that the rapidity with which medical care can be delivered in an emergency medical situation can be determinative of the successful recovery for the victim. For example, wounds which result in excessive bleeding can lead to rapid death. A victim may not recover from a readily survivable wound if treatment is delayed for too long.

Emergency medical equipment can be bulky and prone to disorganization. Items such as intravenous liquid supply equipment, vital sign sensory equipment, such as temperature, blood pressure, heart rate, blood oxygenation sensors, and surgical gear often wrapped to maintain sterility, come in myriad shapes and sizes. Such items can be difficult to rapidly deploy and effectively use when carried in portable containers.

Because of the dangers inherent to security personnel and critical nature of many emergency medical situations, a device which exhibits rapid deployability and superior performance is desirable.

Therefore, there is a need for an apparatus which addresses one or more of the above identified inadequacies.

SUMMARY

The principal and secondary objects of the invention are to provide an improved rapid deployment backpack including a chest protector that is apparently relatively undetectable when stowed. These and other objects can be achieved by a backpack having a disguised, covered anterior chamber carrying a vestment including utility sites and armor, which is deployable over-the-head of a user using visibly obscured pull-tabs.

In some embodiments there is provided a rapidly deployable combination chest protector and utility vestment that is apparently relatively undetectable when stowed.

In some embodiments there is provided an improved backpack comprises: a posterior storage compartment; a pair of shoulder supports extending from a top portion of said backpack to a bottom portion of said backpack; a vestment comprising a first armor panel; an anterior chamber shaped to fully contain said vestment, said chamber having a top opening dimensioned to allow said vestment to pass fully therethrough; a pair of laterally spaced apart belts connecting said vestment to said backpack at a location inside said anterior chamber; a pliable cover releasably covering said top opening of said chamber; a pair of laterally spaced apart, pliable pull-tabs; wherein each pull-tab comprises: a first end, a medial portion, and a second end; wherein said first end is connected to said vestment; wherein said second end is free; wherein said medial portion is releasably and obscurably secured to one or the other of said shoulder supports.

In some embodiments each of said pull-tabs further comprises: a graspable grip formed onto said second end; and wherein said graspable grip is free from attachment to said one or the other of said shoulder supports.

In some embodiments said medial portion of said pull-tab is carried within a longitudinal channel in said shoulder support; and wherein said channel is releasably covered by at least one obscuring flap of material.

In some embodiments said pliable cover releasably seals against a lip bordering said top opening of said chamber; and, wherein said pull-tabs extend through apertures in a seal between said pliable cover and said lip.

In some embodiments said vestment comprises a weapon holster.

In some embodiments said backpack further comprises a pair belts wherein each of said belts has a first end fastened to said backpack, and a second end forming a loop secured to said vestment.

In some embodiments said backpack further comprises a pair of decoy bands extending longitudinally along exposed outer surfaces of said shoulder supports, wherein said decoy bands are shaped, dimensioned and oriented to mimic an extension of said pull-tabs along said shoulder supports.

In some embodiments said decoy bands have a width and thickness dimension commensurate with said pull-tabs.

In some embodiments said decoy bands are positioned to have portions located beneath end grips on said pull-tabs.

In some embodiments said anterior chamber comprises a septum separating said anterior chamber into a front pocket and a back pocket; said front pocket releasably containing a second armor panel.

In some embodiments said backpack further comprises: a medial compartment having a bottom aperture; a caddy removably contained within said medial compartment; said caddy having a bottom spine obstructing said aperture; a handle structure secured to said bottom spine; an openable flap extending over said handle and said aperture.

In some embodiments said caddy comprises a folding utility case comprising: a pair of opposable panels hingedly joined to said spine; wherein said opposable panels and said spine have inner surfaces lined by a layer of fabric fastener; and, a plurality of carried items, wherein each of said carried items has an exposed surface supporting patches of fabric fastener matable to said layer of fabric fastener; whereby each of said carried items can be organized and secured to said inner surfaces.

In some embodiments said medial compartment is lined with a hollow sleeve having a low friction inner surface contacting said insert.

In some embodiments there is provided a method of deploying a protective utility vestment from a backpack comprises: selecting a backpack having a releasably closable anterior chamber shaped and dimensioned to fully and obscurably enclose said utility vestment; grasping the free ends of a pair of pull-tabs attached to said utility vestment and releasably and obscurably secured to said shoulder supports; pulling said pull-tabs into a position wherein said vestment has been drawn over a users head and secured to said users chest; and, securing said pull-tabs to a hip support of said backpack.

In some embodiments there is provided the combination of a backpack and a protective utility vestment, wherein said vestment comprises: a pair of hand graspable pull tabs releasably attached to shoulder supports of said backpack.

The original text of the original claims is incorporated herein by reference as describing features in some embodiments.

DESCRIPTION OF THE EXEMPLARY EMBODIMENTS

Figure 1:
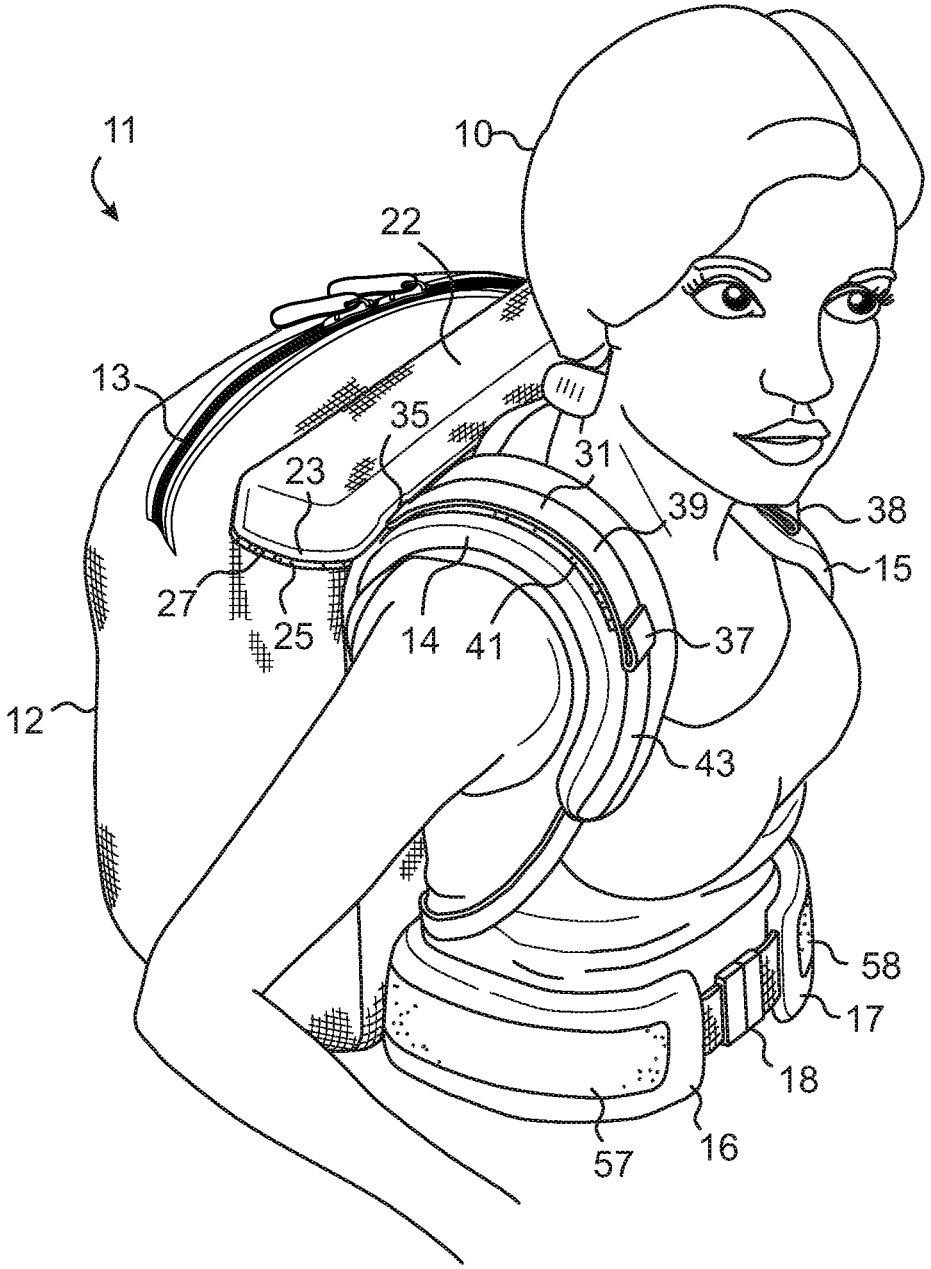
FIG. 1 is a diagrammatic perspective view of a backpack having an obscured rapidly deployable protective utility vestment in the stowed configuration according to an exemplary embodiment of the invention.

In this specification, the references to top, bottom, upward, downward, upper, lower, vertical, horizontal, sideways, lateral, back, front, etc. can be used to provide a clear frame of reference for the various structures with respect to other structures while the backpack is being worn by a user as shown in FIG. 1, and not treated as absolutes when the frame of reference is changed, such as when the backpack is laying on the ground unworn.

The term "substantially" can be used in this specification because manufacturing imprecision and inaccuracies can lead to non-symmetricity and other inexactitudes in the shape, dimensioning and orientation of various structures. Further, use of "substantially" in connection with certain geometrical shapes and orientations, such as "parallel" and "perpendicular", can be given as a guide to generally describe the function of various structures, and to allow for slight departures from exact mathematical geometrical shapes and orientations, while providing adequately similar function. Those skilled in the art will readily appreciate the degree to which a departure can be made from the mathematically exact geometrical references.

Figure 2:
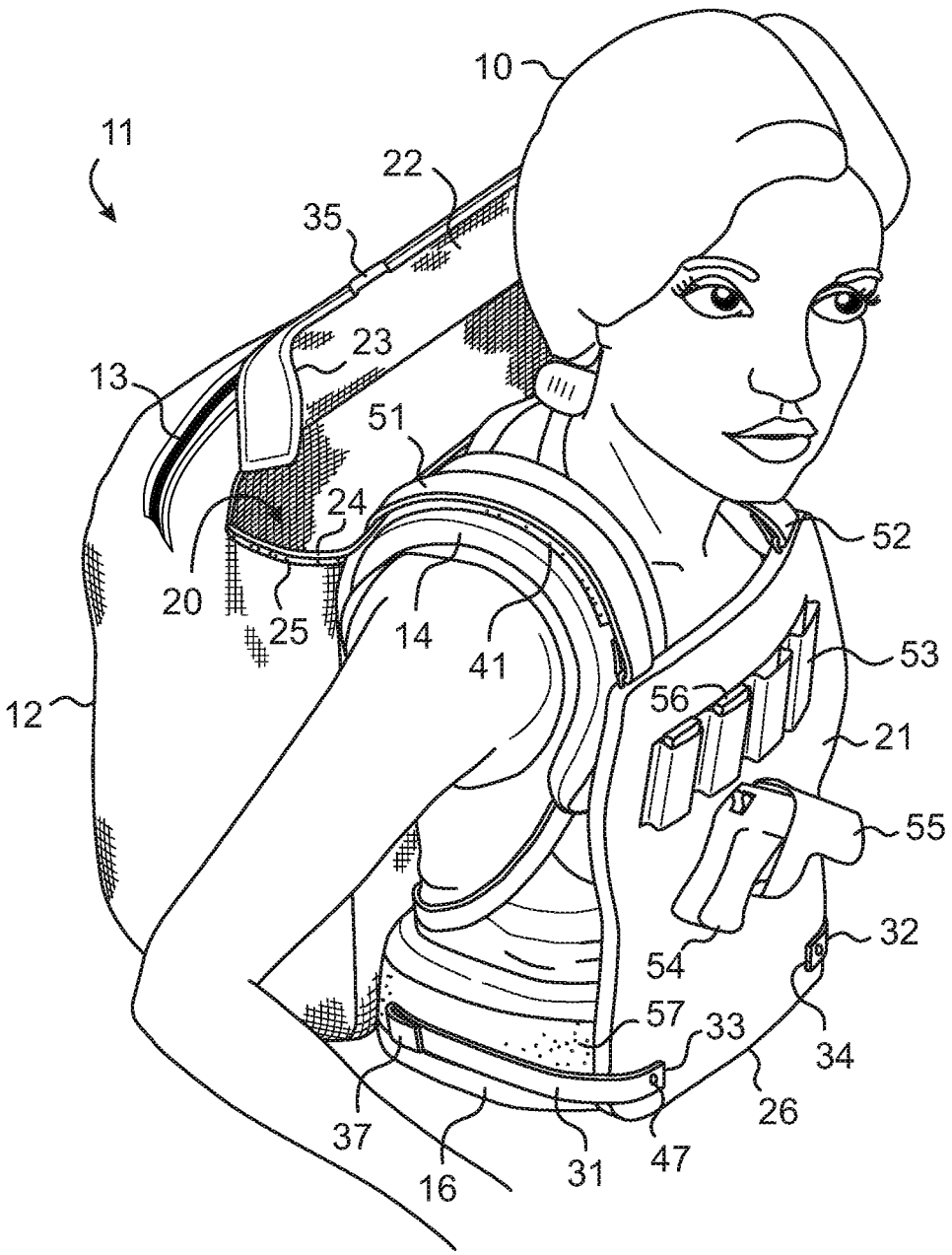
FIG. 2 is a diagrammatic perspective view of the backpack of FIG. 1 where its vestment is in its deployed configuration.

Referring now to the drawing, there is shown in FIGS. 1-4 a backpack 11 worn by a user 10 having a rapidly deployable protective utility vestment 21 according to an exemplary embodiment of the invention. In FIG. 1 the vestment is hidden within the backpack in the stowed configuration. In FIG. 2 the vestment 21 is shown in the deployed configuration.

The backpack 11 includes a posterior enclosure 12 made from a durable, pliable sheet material such as nylon infused fabric. The enclosure houses a posterior storage compartment openably sealed by zipper-type fastener 13 as is typical of backpack-type devices. The backpack includes other apparently common backpack features such as padded shoulder supports 14,15 and a padded hip support having a pair of enwrapping jaws 16,17 which buckle together using a front buckle 18.

In addition to the posterior storage compartment, the enclosure also houses an anterior chamber 20 shown in FIG. 2. The anterior chamber is shaped and dimensioned to fully and obscurably carry a utility vestment 21 when the vestment is carried in its stowed configuration as shown in FIG. 1. A pliable cover 22 obscures the vestment while stowed in the anterior chamber. The cover releasably seals along a section of its perimeter 23 to the lip 24 of the top opening of the anterior chamber by a rapidly breakable seal 27 using fastening means such as corresponding patches 25 of a hook-and-loop fabric fastener (hereinafter "fabric fastener") such as Velcro brand fastener, cooperating magnets, or other fasteners. The anterior chamber and cover can stow the entire vestment in an obscured manner. In other words, the existence of the vestment is not visually apparent when it is in its stowed configuration because, as will be further described below, no identifying part of the vestment is readily visible.

Figure 4:
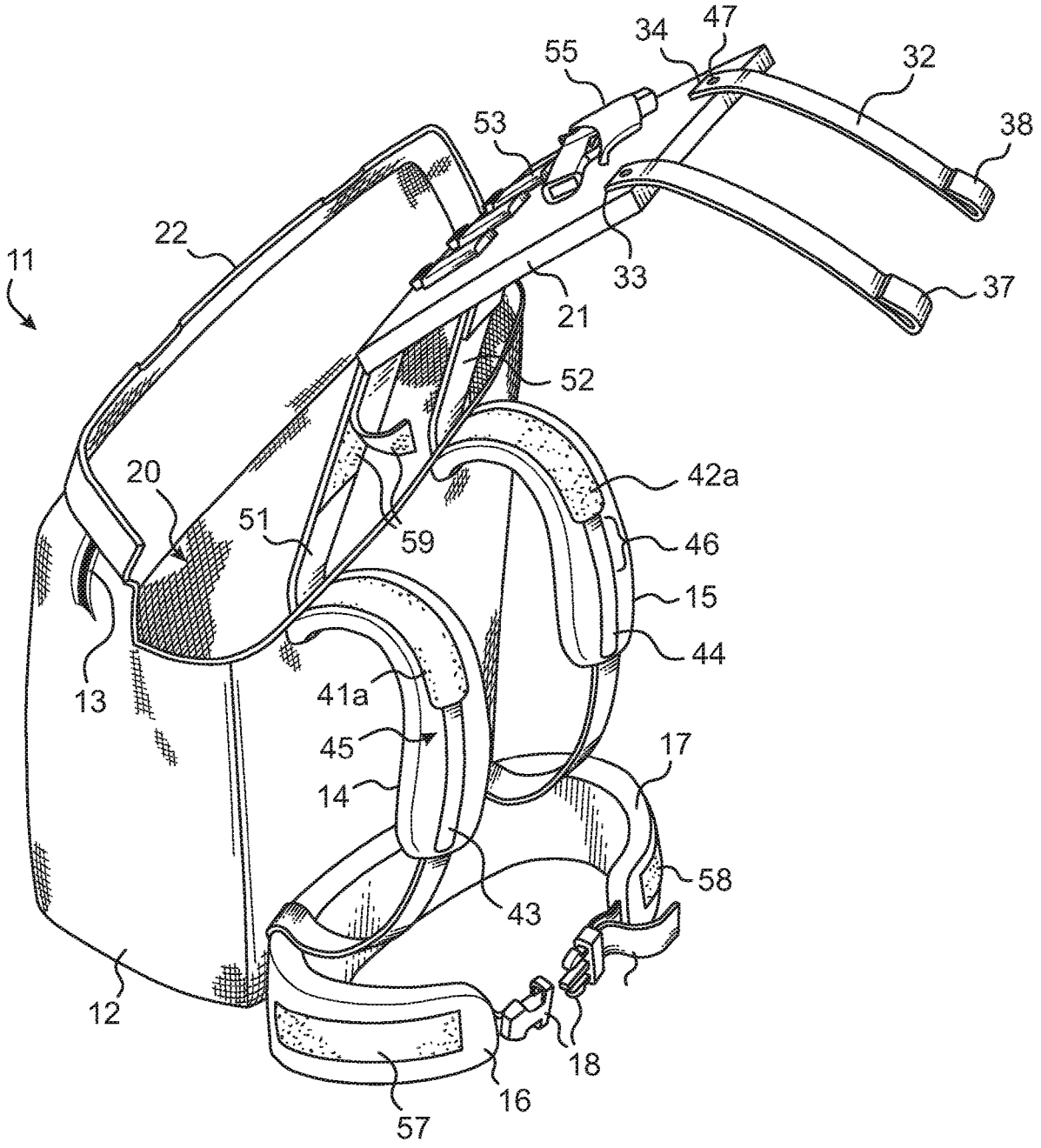
FIG. 4 is a diagrammatic perspective view of the backpack of FIG. 3 between its stowed and deployed configuration.

A pair of obscured pull-tabs 31,32 allow the user 10 to deploy the vestment 21 from its stowed configuration as shown in FIG. 1. Each tab connects at a first, attached end (33,34 as shown in FIGS. 2 and 4) to the vestment, and extend out from under the cover 22 through apertures 35,36 in the seal 27. The opposite free end of each pull-tab forms a hand-graspable grip, such as a loop 37,38 of strip material sized to accept the user's fingers and/or thumbs to help ensure a firm grasp of the pull-tabs prior to and during deployment. A medial portion 39,40 of each pull-tab can run longitudinally along, and contacting the outer exposed surface of the shoulder supports 14,15 of the backpack 11. Corresponding patches 41*a*,41*b*,42*a*,42*b* of fabric fastener can be positioned on the outer surface of the shoulder supports and on the medial sections of the pull-tabs. In this way, the pull-tabs can be held in place on the outer surface of the shoulder supports for ready grasping by the user. Because the pull-tabs run flush with the outer surface of the shoulder supports, the pull-tabs are obscured, appearing to merely be a unitary component of the shoulder supports. Enhancing the obscurity are a pair of decoy bands 43,44 shaped and dimensioned to mimic the pull-tabs, having commensurate width and thickness dimensions. Thus, the decoy bands can be made of a similar or identical material as the pull-tabs, and can have similar or identical colors. The proximal end portions 45,46 of the decoy bands can be located to underlie the distal grips 37,38 of the pull-tabs so that the grips do not adhere to the shoulder supports. In this way, the decoy bands can be selected to avoid enhanced frictional contact with the material of the grips so that the grips are readily graspable. In other words, the fabric fastener patches on the shoulder supports may not extend to a longitudinal position underlying the grips where contact could occur.

Referring now to FIG. 2, the backpack 11 is shown in its deployed configuration where the utility vestment 21 is draped over the chest of the user 10. It should be noted that the utility vestment can include more than protective body armor such as a panel of projectile resistant material, such as Kevlar brand material available from DuPont, of Midland, Mich., but can also include a weapon 54 secured in a readily available manner to a holster 55 attached to the front of the vestment, and accessory attachment sites 53 for carrying accessories such as replacement ammunition cartridges 56, fresh batteries, wireless communication device and other gear.

The vestment can be secured to the chest by a pair of belts 51,52 straddling the user's head and resting on the shoulder supports 14,15 of the backpack. Each belt adjustably connects the vestment to the backpack. The undersurfaces of the belts can include patches of fabric fastener corresponding to the patches 41*a*,42*a* on the outwardly exposed surfaces of the shoulder supports in order to further secure the position of the vestment on the chest. The belts can form a loop, locked by corresponding fabric fastener patches 59, which allow the distance between the deployed vestment and backpack to be adjustable. In addition, the vestment can be easily detached and swapped out for another vestment having different properties and/or accessories. Furthermore, the pull-tabs 31,32 can be releasably attached to the corresponding fabric fastener patches 57,58 located of the outer surfaces of the jaws 16,17 of the hip support pads. The attached ends 33,34 of the pull-tabs can attach to the lower edge of the vestment 21 using hinges 47 which allow the pull-tabs to swivel outwardly and extend directly over the lateral edges of the vestment to more readily engage the hip support pads.

Figure 3:
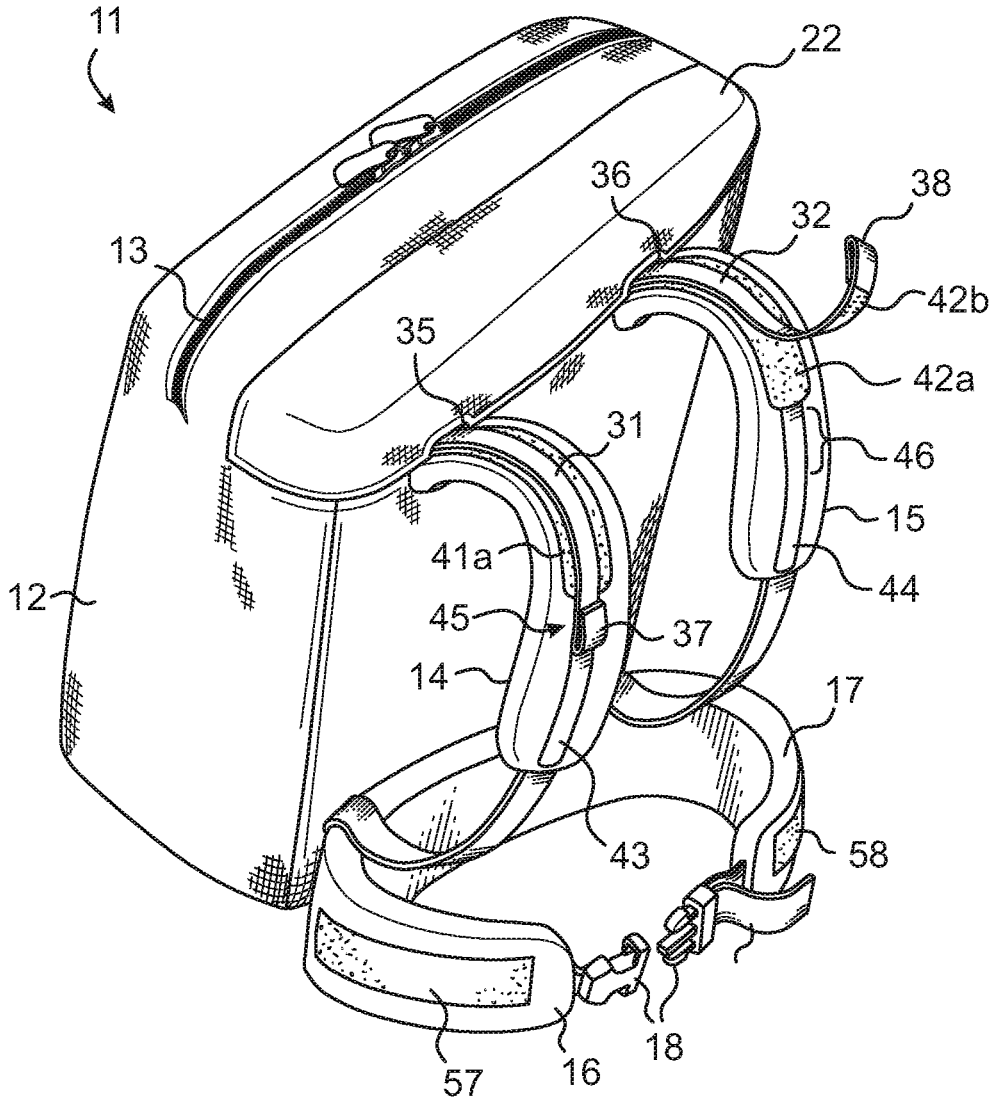
FIG. 3 is a diagrammatic perspective view of the backpack in its stowed configuration according to an exemplary embodiment of the invention.

FIGS. 3 and 4 show the backpack sans the user for greater clarity of certain elements.

In this way, the vestment can be rapidly and securely deployed from an obscured stowed configuration to a secure, ruggedly fixed deployed configuration in a matter of seconds.

Figure 5:
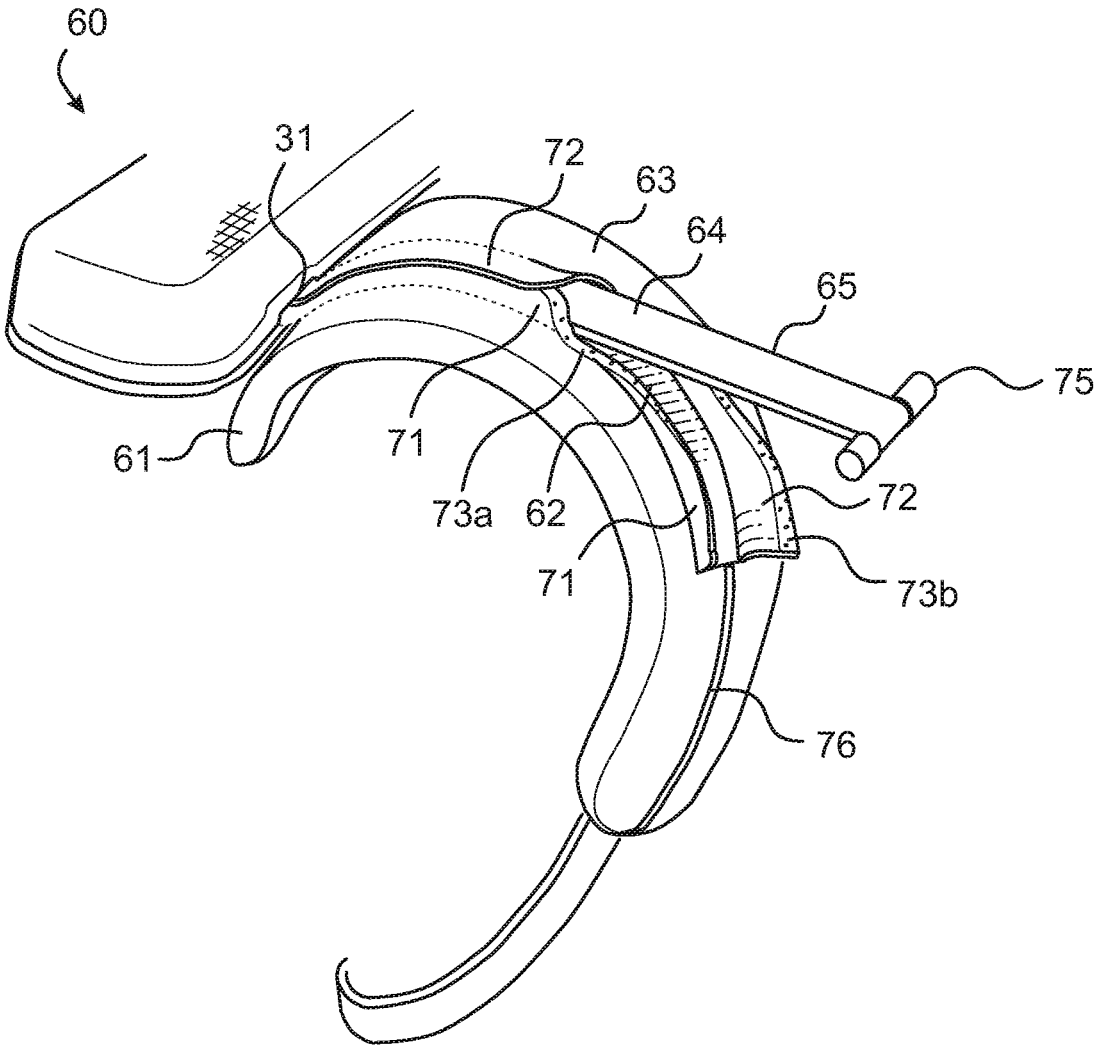
FIG. 5 is a diagrammatic partial perspective view of a shoulder support having a longitudinal channel for obscurably and releasably carrying the medial section of a pull-tab.

As shown in FIG. 5, an alternate embodiment of the backpack 60 can include a shoulder support 61 having a longitudinal channel 62 for obscurably and releasably carrying the medial portion 64 of a pull-tab 65. The channel is set into the exposed outer surface 63 of the shoulder support. The channel is shaped and dimensioned to fully enclose the medial portion of the pull-tab. The channel can be covered along its entire longitudinal length by a pair of laterally folding, tear-away, obscuring flaps 71,72 which releasably adhere to one another along their free edges using cooperative patches 73*a*,73*b* of a fabric fastener. In this way the flaps obscurably and releasably cover the medial portion of the pull-tab running along the channel. When the user grasps and pulls on the distal grip 75 such as an oblong button, attached to the free end of the pull-tab, the tightening pull-tab forces the medial portion to push away the flaps and latitudinally exit the channel. It should be noted that a decoy band in the form of a longitudinal seam 76 can be formed onto the outer surface of the shoulder support distal to the channel. In this way the seam mimics the exposed edge of the overlapping flaps, thus further obscuring the existence of the channel.

Figure 6:
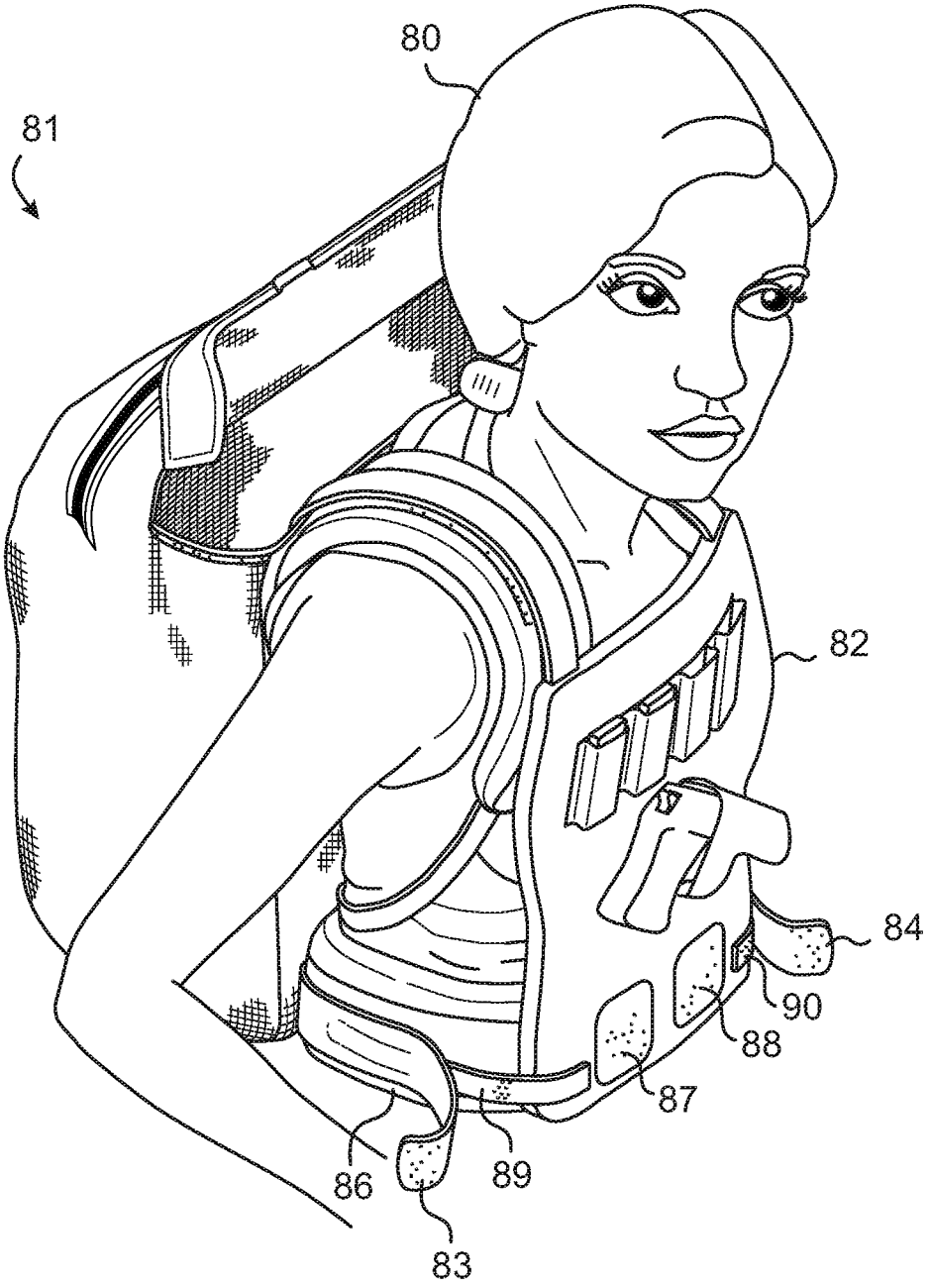
FIG. 6 is a diagrammatic perspective view of a backpack vestment in its deployed configuration having a pair of anchor bands associated with the hip support according to an exemplary embodiment of the invention.
Figure 7:
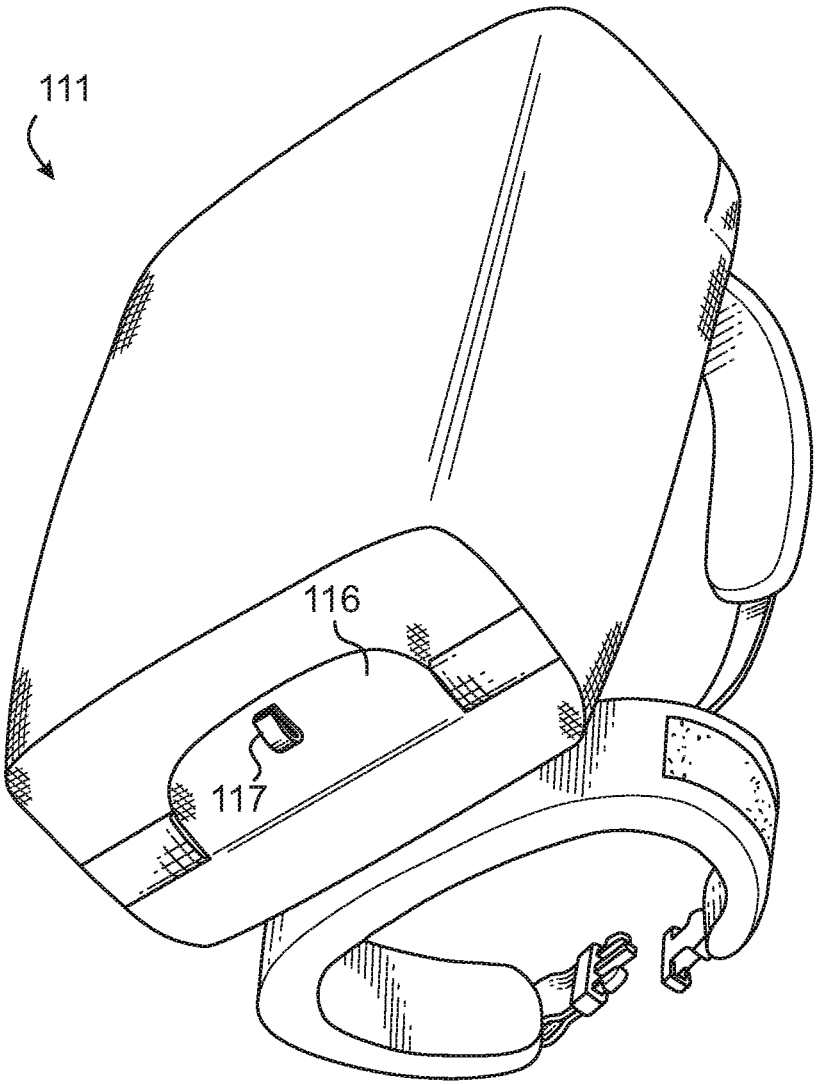
FIG. 7 is a diagrammatic perspective view of a backpack having an obscured bottom deployable utility caddy in its stowed configuration according to an exemplary embodiment of the invention.

As shown in FIG. 6, an alternate embodiment of the backpack 81 provides further securement of the vestment 82 to the chest of the user 80 in the form of a pair anchor bands 83,84 extending from posterior sections of the enwrapping jaws 86 of the padded hip support. The inside surface of each anchor band includes patches of fabric fastener corresponding to patches 87,88 on the lower front surface of the vestment. The anchor bands can extend over, and secure in place the pull-tabs 89,90 already adhered to the hip support.

Thus the protective utility vestment can be deployed from a backpack by selecting a backpack having a releasably closable anterior chamber shaped and dimensioned to fully and obscurably enclose the utility vestment; grasping the free ends of a pair of pull-tabs attached to the utility vestment and releasably and obscurably secured to the shoulder supports; pulling the pull-tabs into a position wherein the vestment has been drawn over a users head and secured to the users chest; and, securing the pull-tabs to a hip support of the backpack.

Referring now to FIGS. 7-11 there is shown a backpack 111 according to an alternate exemplary embodiment of the invention. The backpack can have all the features of the embodiment of FIG. 1, and include a rapidly deployable caddy 112 for releasably carrying a number of items 113 such as emergency medical devices removably secured and organized upon inner surfaces 114 of the caddy. The caddy can be fully contained within a medial compartment 115 of the backpack in the stowed configuration shown in FIG. 7. A cover flap 116 obscures and protects the exposed bottom of the caddy in its folded, stowed configuration. The cover flap is held in place by a fabric fastener 107, and can be opened by pulling on a finger loop 117.

Figure 8:
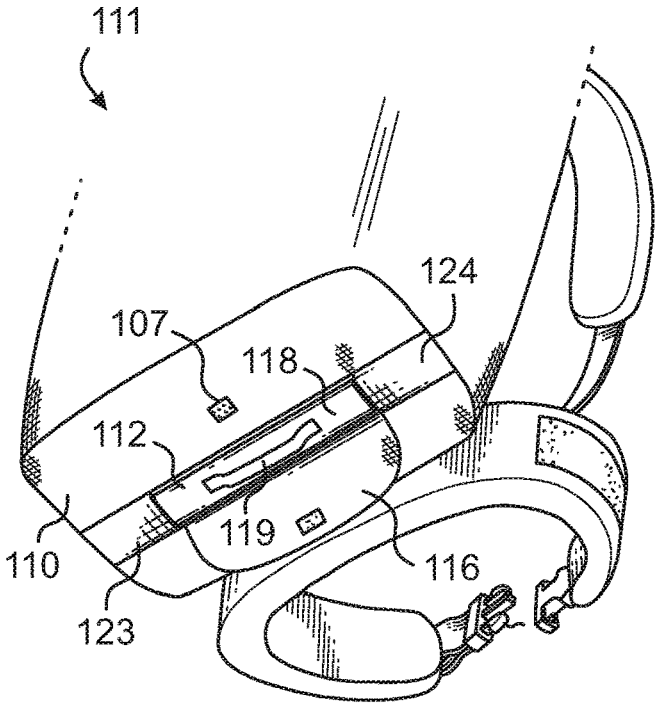
FIG. 8 is a diagrammatic partial perspective view of the backpack of FIG. 7 where the caddy cover flap is opened.

FIG. 8 shows that in order to remove the caddy 112 from the bottom 110 of the backpack 111, the cover flap 116 can be flipped open revealing the bottom spine 118 of the caddy having a hand graspable handle 119. Until the handle is pulled downwardly, the caddy is held in place by a pair of forceably released buckles 122*a*,122*b*,122*c*,122*d* which automatically disengage when sufficient downward force is applied to the handle. The receptor portions 122*b*,122*d* of the forceably released buckles are partially enclosed by fabric sleeves 123,124 which obscure and protect the caddy in the stowed configuration.

The medial compartment 115 has a bottom aperture 108 from which the caddy 112 can be extracted. The inner surfaces of the medial compartment can be lined with a low friction guide sleeve 120 made from a durable, hard plastic which is interposed between the fabric of the backpack medial compartment and the caddy being deployably carried therein. In the stowed configuration the bottom aperture is obstructed by the spine 118 and the receptor portion sleeves 123,124. In this way the entire caddy can be stowed within the backpack in a fully obscured manner. In other words, the existence of the caddy is not visually apparent when it is in its stowed configuration because, as will be further described below, no identifying part of the caddy is readily visible.

Figure 9:
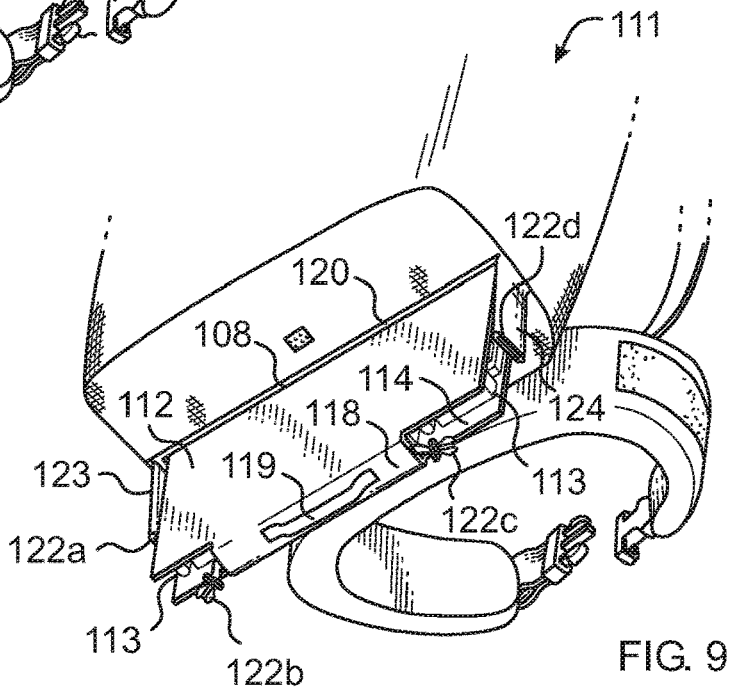
FIG. 9 is a diagrammatic partial perspective view of the backpack of FIG. 7 where the caddy is in its folded configuration and is being partially extracted.
Figure 10:
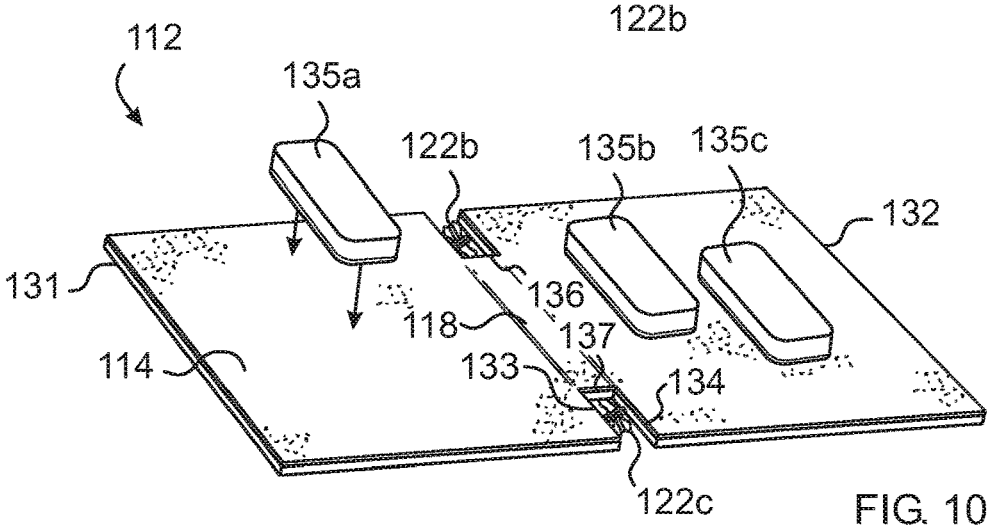
FIG. 10 is a diagrammatic perspective view of the caddy in its open, deployed configuration.

FIG. 10 shows that the caddy 112, now in its deployed and unfolded configuration, can be in the form of a folding utility case including a pair of panels 131,132 bound together along substantially parallelly spaced apart edges 133,134 by a common binding forming the spine 118. The panels hingedly attach to the binding so that the panels can be folded over into an opposed, substantially parallelly spaced apart configuration as shown in FIG. 9. In this way the caddy assumes a substantially quadrangular shape which slidingly inserts intimately into the medial compartment 115. The panels and binding can be made from a durable rigid material such as polyvinyl plastic and covered by fabric. A layer of fabric fastener can cover the entire inner surfaces 114 of the panels and spine. Corresponding patches of fabric fastener can be attached to surfaces on various items 135*a*,135*b*,135*c* such as emergency medical devices so that they may be removably secured and organized upon the inner surfaces of the caddy.

A pair of notches 136,137 extend inwardly along the folding axis of the caddy toward opposite ends of the spine 118. The receptor portions 122*a*,122*d* of the forceably released buckles extend into the notches in the stowed configuration. In this way the forceably released buckles can conveniently swing out of the way as the caddy 112 is extracted from the backpack.

Figure 11:
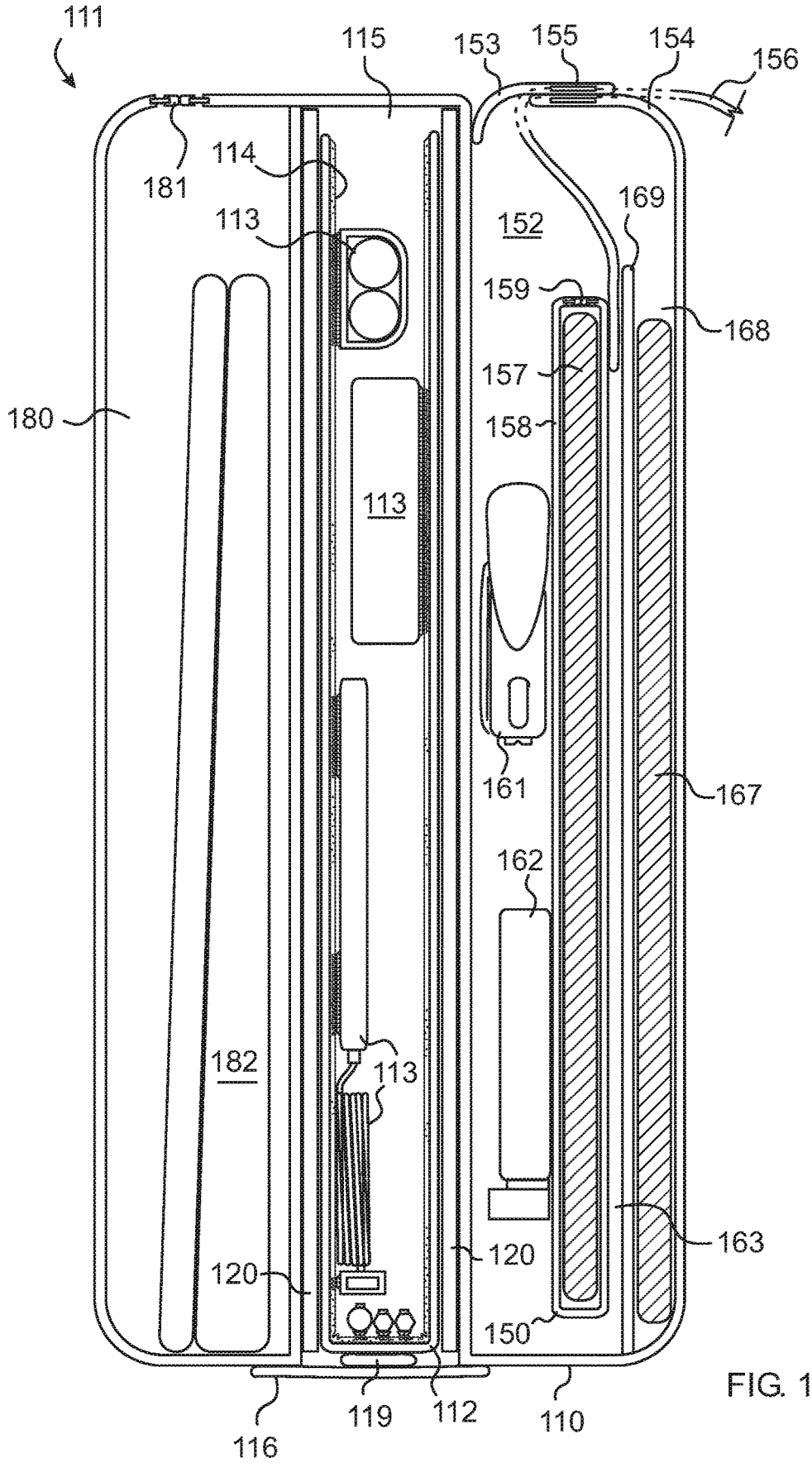
FIG. 11 is an illustrative, diagrammatic, partially cross-sectional side view of the backpack in which the caddy and protective vestment are in their stowed configurations.

FIG. 11 shows a illustrative cross-sectional view of the backpack 111 in which the caddy 112 is in its stowed configuration. Further, the protective vestment 151 is shown stowed configuration in the anterior compartment 152 of the backpack. In this embodiment, the anterior compartment is openably covered by a pair of flaps 153,154 releasably secured to one another by a corresponding pair of ferromagnet breakaway fasteners 155 which automatically separate under the force of the vestment being extracted. Pull tabs 156 extend out through gaps (not shown) between the cover flaps. A panel 157 of protective body armor can be replaceably contained within a pouch 158 forming the bulk of the vestment. A zipper-type fastener 159 can openably seal the pouch. The anterior compartment is sized to accommodate the vestment having a weapon 161 secured to the front of the vestment, and other accessories such as replacement ammunition cartridges 162. The belts connecting the vestment to the backpack are not shown for clarity, but would occupy a portion 163 of the space in the anterior compartment. A secondary panel 167 of protective body armor can be replaceably contained within an front pocket 168 formed by a septum 169 separating the anterior compartment into back and front pockets.

The backpack can also have a posterior compartment 180 openably sealed by zipper-type fastener 181 and can contain a laptop 182 or other items.

Figure 12:
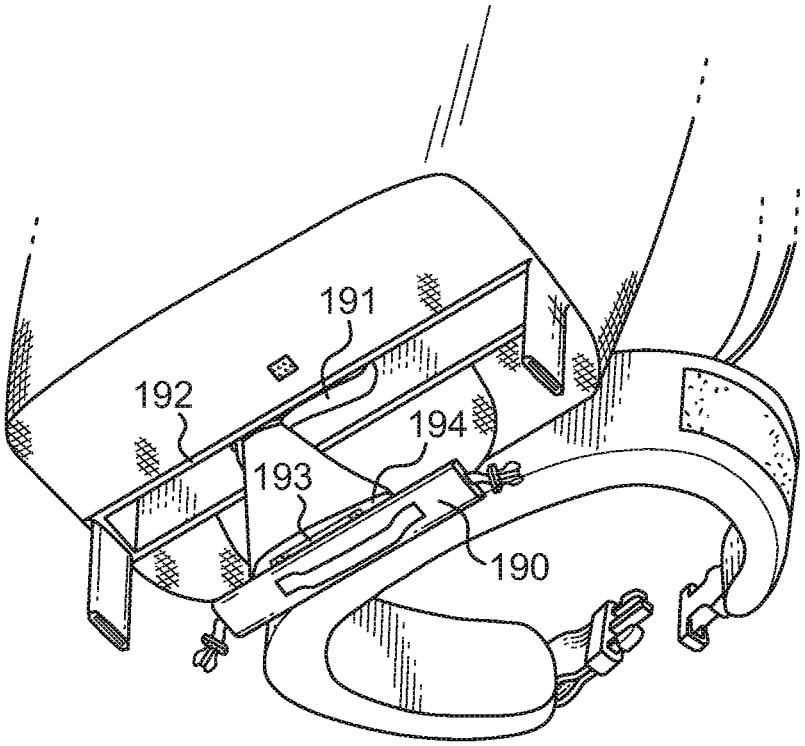
FIG. 12 is a diagrammatic partial perspective view of the backpack of FIG. 7 where the caddy spine is adapted to carry a bulky item such as a weapon and is being partially extracted.

FIG. 12 shows that the caddy 190 can be adapted to carry a bulky, disuniformly-shaped item such as a weapon 191 or other items having numerous snag-prone features, such as collapsible stands for intravenous fluid supply equipment. A low-friction guide sleeve 192 allows for rapid deployment of such items without snags. The disuniformly-shaped item can be releasably secured to the inner surface of the spine using one or more patches 193 of fabric fastener attached to a bottom surface 194 of the disuniformly-shaped item and which cooperatively adhere to the fabric fastener layer of the inner surface of the spine.

While the preferred embodiments of the invention have been described, modifications can be made and other embodiments may be devised without departing from the spirit of the invention and the scope of the appended claims.

What is claimed is:

1. An improved backpack comprises:
- a posterior storage compartment;
- a pair of shoulder supports extending from a top portion of said backpack to a bottom portion of said backpack;
- a vestment comprising a first armor panel;
- an anterior chamber shaped to fully contain said vestment, said chamber having a top opening dimensioned to allow said vestment to pass fully therethrough;
- a pair of laterally spaced apart belts connecting said vestment to said backpack at a location inside said anterior chamber;
- a pliable cover releasably covering said top opening of said chamber;
- a pair of laterally spaced apart, pliable pull-tabs;
- wherein each pull-tab comprises:
  - a first end, a medial portion, and a second end;
  - wherein said first end is connected to said vestment;
  - wherein said second end is free;
  - wherein said medial portion is releasably and obscurably secured to one or the other of said shoulder supports.

2. The backpack of claim 1, wherein each of said pull-tabs further comprises:
- a graspable grip formed onto said second end; and wherein said graspable grip is free from attachment to said one or the other of said shoulder supports.

3. The backpack of claim 1, wherein said medial portion of said pull-tab is carried within a longitudinal channel in said shoulder support; and wherein said channel is releasably covered by at least one obscuring flap of material.

4. The backpack of claim 1, wherein said pliable cover releasably seals against a lip bordering said top opening of said chamber; and, wherein said pull-tabs extend through apertures in a seal between said pliable cover and said lip.

5. The backpack of claim 1, wherein said vestment comprises a weapon holster.

6. The backpack of claim 1, which further comprises a pair belts wherein each of said belts has a first end fastened to said backpack, and a second end forming a loop secured to said vestment.

7. The backpack of claim 1, which further comprises a pair of decoy bands extending longitudinally along exposed outer surfaces of said shoulder supports, wherein said decoy bands are shaped, dimensioned and oriented to mimic an extension of said pull-tabs along said shoulder supports.

8. The backpack of claim 7, wherein said decoy bands have a width and thickness dimension commensurate with said pull-tabs.

9. The backpack of claim 8, wherein said decoy bands are positioned to have portions located beneath end grips on said pull-tabs.

10. The backpack of claim 1, wherein said anterior chamber comprises a septum separating said anterior chamber into a front pocket and a back pocket; said front pocket releasably containing a second armor panel.

11. The backpack of claim 1, wherein said backpack further comprises:
- a medial compartment having a bottom aperture;
- a caddy removably contained within said medial compartment;
- said caddy having a bottom spine obstructing said aperture;

a handle structure secured to said bottom spine;

an openable flap extending over said handle and said aperture.

12. The backpack of claim 11, wherein said caddy comprises a folding utility case comprising:

a pair of opposable panels hingedly joined to said spine;

wherein said opposable panels and said spine have inner surfaces lined by a layer of fabric fastener; and, a plurality of carried items, wherein each of said carried items has an exposed surface supporting patches of fabric fastener matable to said layer of fabric fastener;

whereby each of said carried items can be organized and secured to said inner surfaces.

13. The backpack of claim 11, wherein said medial compartment is lined with a hollow sleeve having a low friction inner surface contacting said insert.

14. The method of deploying a protective utility vestment from a backpack comprises:

selecting a backpack having a releasably closable anterior chamber shaped and dimensioned to fully and obscurably enclose said utility vestment;

grasping the free ends of a pair of pull-tabs attached to said utility vestment and releasably and obscurably secured to said shoulder supports;

pulling said pull-tabs into a position wherein said vestment has been drawn over a users head and secured to said users chest; and, securing said pull-tabs to a hip support of said backpack.

* * * * *